United States Patent [19]

Homick et al.

[11] 3,957,505

[45] May 18, 1976

[54] GOLD RECLAMATION PROCESS

[75] Inventors: Richard P. Homick, San Francisco, Calif.; Hilbert Sloan, Scottsdale, Ariz.

[73] Assignee: Bayside Refining and Chemical Company, Santa Clara, Calif.

[22] Filed: Aug. 5, 1974

[21] Appl. No.: 494,794

[52] U.S. Cl. ..... 75/108; 75/118 R; 423/505; 423/38; 423/463

[51] Int. Cl.[2] ..... C22B 11/00

[58] Field of Search ..... 75/.5 A, 101 R, 118, 75/108; 134/1, 10, 13; 156/8, 19; 204/46 G; 423/505

[56] References Cited

UNITED STATES PATENTS

| | | | |
|---|---|---|---|
| 2,304,823 | 12/1942 | Harrison | 75/118 |
| 3,390,981 | 7/1968 | Hoffman | 75/118 X |
| 3,495,976 | 2/1970 | Bazilevsky et al. | 75/101 R |
| 3,625,674 | 12/1971 | Jacobs | 75/101 R |

OTHER PUBLICATIONS

Masterton et al., *Chemical Principles*, 2nd Ed., W. B. Saunders Co., Phila, Pa. 1966, pp. 466–469.

Audrieth et al., *The Chemistry of Hydrazine*, John Wiley & Sons, New York, 1951, pp. 116,127,136,160.

*Primary Examiner*—Herbert T. Carter
*Assistant Examiner*—Brian E. Hearn
*Attorney, Agent, or Firm*—Roger Norman Coe; Thomas M. Ferrill, Jr.

[57] ABSTRACT

Gold is recovered from gold bearing materials by dissolving gold in an iodide-iodine solution, precipitating gold with a reducing solution, removing the precipitated gold and then regenerating the iodide-iodine solution with an oxidizing agent.

16 Claims, No Drawings

GOLD RECLAMATION PROCESS

FIELD OF THE INVENTION

The present invention relates to a process for recovery of gold from gold bearing materials and, more particularly, to a process for reclaiming gold from gold plated scrap materials by dissolving the gold in an iodide-iodine solution, precipitating gold from the solution, removing the gold and then regenerating the iodide-iodine solution by oxidation of the filtrate.

BACKGROUND OF THE INVENTION

One of the oldest commercial processes for dissolving gold is the so-called "cyanide process" which is illustrated by the following reaction:

$$2Au + \frac{1}{2}O_2 + H_2O + 4CN^- = 2Au\,(CN)_2^- + 2OH^-$$

The cyanide ion forms such a stable complex with aurous gold that when the cyanide ion is present oxygen of the air is sufficient to oxidize gold. The effectiveness of the cyanide process has led to its commercial usage for both extraction of gold from its ores and for the reclamation of gold from gold coated scrap parts. Generally a potassium cyanide solution is used in the "cyanide process". This solution is very toxic and disposing of spent cyanide solution has become a significant and increasing waste disposal and pollution abatement control problem.

Gold has also been dissolved using a mixture of hydrochloric acid and nitric acid, known as "aqua regia", in order to obtain the complex chlorauric acid, $HAuCl_4$. Aqua regia, however, is extremely corrosive and yields toxic fumes.

In order to avoid the use of very toxic chemicals and mitigate waste disposal and pollution abatment control problems attempts have been made to develop an economically viable process for the reclamation of gold. With the skyrocketing price of gold and industry's concern about ecology a new commercially feasible gold reclamation process has been sought which is relatively safe from a production viewpoint and which mitigates pollution abatement problems.

A new process has now been developed. While not limited solely to reclamation type operations, the new process is particularly effective in recovering gold from parts and devices used in the electronics industry including gold plated printed circuit boards and other gold coated metal, plastic, glass and ceramic parts. Such parts may contain between 2 and 100 micro inches of plated gold. The new process involves the use of a potassium iodide-iodine solution to dissolve the gold. While such a solution has been used to etch out thin film gold circuits in microelectronic devices and to strip plated gold for thickness measurements, potassium iodide-iodine solutions have heretofore been considered too expensive for consideration in any commercial operation for recovering gold.

SUMMARY OF THE INVENTION

An object of the present invention is to provide a process for the recovery of gold from gold bearing material.

Another object of the present invention is to provide a process for the reclamation of gold from gold plated scrap materials which avoids the use of extremely corrosive and toxic materials and which accordingly avoids significant pollution problems.

Still another object of the present invention is to provie an economical process for the reclamation of gold utilizing a potassium iodide-iodine solution.

In accordance with the present invention, an aqueous iodide-iodine solution is employed to dissolve gold. The dissolved gold is then precipitated with a reducing solution. Precipitated gold can be recovered for example, by filtration. The iodide-iodine solution is then regenerated by oxidation of the filtrate. The process presents a commercially feasible gold reclamation process which is relatively safe to use and which mitigates pollution abatement problems. The process is particularly advantageous in recovering gold from gold plated electronic components. In a preferred embodiment the gold is precipitated and the iodide-iodine solution is regenerated in the presence of a buffer.

Other and further objects, advantages and features of the invention will be apparent to those skilled in the art from the following detailed description thereof.

DESCRIPTION OF THE PREFERRED EMBODIMENTS

The present invention involves a process for recovering gold in an iodide-iodine water solution and then regenerating the solution. The process is particularly applicable to reclaiming gold from printed circuit boards and other electrical parts used in the electronic industry which have gold contacts, gold plating, gold layers, etc.

The process of the invention utilizes iodine to oxidize the gold while iodide contributes to solubilizing the oxidized gold by formation of a gold iodide complex. Once the gold is dissolved it is then precipitated using a reducing material, the gold precipitate is filtered off and finally the iodide-iodine solution is regenerated by adding an oxidizing agent.

Sulfur dioxide may be used as a reducing agent in an acid environment to precipitate gold from the iodide-iodine solution. The solution is regenerated for further gold stripping by adding a solution of hydrogen peroxide or bubbling ozone thru it.

Hydroxylamine or hydrazine may be used as the reducing agent in an alkaline environment to precipitate gold from the iodide-iodine solution. The solution is then slightly acidified prior to reoxidation with hydrogen peroxide or ozone.

Salts will build up after repeated cycles and reduce the effectiveness of the iodide-iodine stripping solution with respect to speed and capacity after repeated additions of $H^+$ and $OH^-$ ions required for the various reactions of the process. This build up problem is overcome in a preferred embodiment of the invention by adding a buffer to the solution which serves as a source of both $H^+$ and $OH^-$ ions. The use of a buffer with pH's spanning the pH values (about 5 to about 9) at which $H_2O_2$ oxidizes $I_3^-$ and $NH_2OH$ reduces $AuI_4^-$ permits the same solution to be used repeatedly without the degree of salt buildup which would otherwise occur if acid and/or alkali is employed to adjust acidity. Salts of weak acids and a weak base, for example, store both $H^+$ and $OH^-$ ions in solution in such a manner as to render them available to hydroxyl amine ($NH_2OH$) and hydrogen peroxide ($H_2O_2$), respectively. The following equation shows the conversion of dibasic ammonium phosphate to ammonium hydroxide and monobasic ammonium phosphate in the presence of water, thereby serving as a source of both $H^+$ and $OH^-$ ions.

$$(NH_4)_2\,HPO_4 + H_2O \rightarrow NH_4\boxed{OH} + NH_4\boxed{H_2}PO_4$$

The gold recovery process of the invention can best be seen by reference to the following series of reactions:

Iodine, $I_2$, in an aqueous solution of potassium iodide, KI, is present as the tri-iodide anion:

$$I_2 + KI \rightarrow K^+ + I_3^+$$

The reaction between gold and tri-iodide anion can be written as follows:

$$3K^+ + 3I_3^- + 2Au \rightarrow 2KAuI_4 + K^+ + I^-$$

Gold in the form of gold hydroxide, $Au(OH)_3$, or auric oxide ($Au_2O_3$), is formed as a yellow-to-brown precipitate, very insoluble in water, when an alkali hydroxide is added to the potassium auric iodide material. Gold itself rather than gold hydroxide is precipitated in the presence of a reducing agent:

$$KAuI_4 + 4NH_2OH + OH^- \rightarrow Au\downarrow + 2N_2\uparrow + K^+ + 4I^- + 5H_2O$$

In contrast to the purity of gold recovered by the cyanide process (approximately 99.95%), gold recovered by the present process has a purity of 99.99%. Higher purity gold can be recovered by repeating the process. Elemental iodine regeneration also occurs with the addition of an oxidizing agent such as hydrogen peroxide:

$$2I^- + 2H^+ + H_2O_2 \rightarrow I_2 + 2H_2O$$

It will be noted that $OH^-$ ions are consumed during the precipitation reaction and that $H^+$ ions are consumed during the iodine regeneration reaction. It is for this reason that a buffer is preferably used during the process. As previously indicated a buffer such as dibasic ammonium phosphate in the presence of water provides $OH^-$ ions in the form of ammonium hydroxide and $H^+$ ions in the form of monobasic ammonium phosphate.

The process of the invention can be carried out in any suitable container since unlike prior gold reclamation processes the use of very toxic and very corrosive materials are avoided. Stainless steel, type 18-8, is one example of a suitable container material although other materials such as enameled steel, polyethylene, polypropylene, polyvinyl chloride and the like can be used.

Advantageously, an agitator or tumbler is used during the stripping reaction. The agitator or tumbler can be made of stainless steel, a non-metallic material such as enameled steel, a plastic, or a plastic lined material. During precipitation of the gold from a gold rich solution little or no agitation is required.

Any suitable means can be used to remove the precipitated gold. Settling and decanting, filtering the solution through a filter press or centrifuging are convenient procedures for such removal.

If desired, the speed of the process can be increased by either heating the stripping solution or applying an electromotive force to the solution, using the material to be deplated as an anode. However, it is ordinarily not necessary to use such measures since the process is faster then the conventional cyanide process.

While a preferred stripping solution is made up on a weight basis of 1 part iodine, 4 parts potassium iodide and 10 parts of water these proportions are not critical. Aqueous solutions ranging from 1:0.7 to 1:20, on a weight basis, of iodine to potassium iodide can be used. When used on similar pieces of scrap containing 2 microinchs of gold plating a 1:4:10 (iodine to potassium iodide to water) stripping solution removed 1 microinch per minute whereas a 1:0.7:10 (iodine to potassium iodide to water) stripping solution required 5 minutes to remove the 2 microinches of gold plating.

Generally, an effective stripping solution may be prepared by adding to elemental iodine an aqueous solution of any soluble iodine compound that yields iodide anion and a cation that is inert with respect to the chemical reactions of the processing steps. Specific examples include sodium iodide, calcium iodide and the like.

Other reducing agents can be employed in place of hydroxylamine. Generally, any compound with a half cell potential that is reducing with respect to $AuI_2^-$ and $AuI_4^-$ in the chemical environment of the stripping solution may be used. Such reducing agents include hydrazine; sodium thiosulfate; sodium hydrosulfite; sodium meta bisulfite; sodium hypophosphite; sodium boro-hydride; sulfur dioxide and the like. Hydroxylamine can be prepared by neutralizing hydroxyl amine hydrochloride or sulfate with an alkali, such as potassium hydroxide or sodium hydroxide.

Iodide-iodine solution regeneration is preferably accomplished by (*a*) decreasing the pH of the solution to below 7 after precipitation of the gold and (*b*) adding a chemical compound with a half cell potential which is oxidizing with respect to iodine in the solution. In addition to hydrogen peroxide, $MnO_4^-$, $Cr_2O_7^=$, $Na_2O_2$, $Cl_2$, $Br_2$ and the like can be employed. After repeated regenerations if any interfering salt buildup decreases the effectiveness of the solution all iodine can be recovered as elemental iodine by precipitation from solution by acidifing and adding an oxidizing agent. The resulting elemental iodine crystals are removed and used to form a new stripping solution.

Examples of suitable buffers which can be used include any material which can supply both $H^+$ and $OH^-$ ions in the approximate pH range of between 5 and 9 and preferably between 6 and 8. Specific examples include dibasic potassium hydrogenphosphate ($K_2HPO_4$), ammonium acetate ($NH_4C_2H_3O_2$), potassium acetate ($KC_2H_3O_2$), sodium acetate ($NaC_2H_3O_2$), potassium citrate ($K_3C_6H_5O_7$), sodium citrate ($Na_3C_6H_5O_7$) and a solution of ammonium chloride ($NH_4Cl$) and ammonium hydroxide ($NH_4OH$).

Depending on the nature of the gold bearing material being treated base metals such as copper and/or nickel may gradually build up in the solution. When this occurs it can slow down the rate of stripping and the iodine can be removed to form a new iodide-iodine stripping solution. This recovery and the reuse of elemental iodine results in an economical process.

The invention is further illustrated by the following specific embodiment.

EXAMPLE

A potassium iodide-iodine solution for stripping gold is prepared by adding on a weight basis 1 part of iodine to 4 parts of potassium iodide to 10 parts of distilled water. Specifically, the potassium iodide is weighed out, added to the water and then stirred until dissolved.

After the potassium iodide is dissolved, the weighed portion of iodine is added with stirring.

Various gold plated parts are immersed in the stripping solution at 35° – 40° C. until the gold is completely removed. The gold is precipitated by adding a 30% hydroxylamine hydrochloride solution which has been neutralized to pH=7 using NaOH: This is added until the solution turns from brown to clear. Then an excess amount equal to ⅓ of that added is used to insure complete precipitation of gold. Typically, a total of 10–12 ml. of 30% $NH_2OH.HCl$ will remove all gold from 100 ml. of gold bearing stripping solution.

The precipitated gold is removed by filtration and the $I_3^-$ is regenerated to approximately its former strength by adding 5–6 ml of 30% hydrogen peroxide to every 100 ml. of stripping solution.

From the foregoing it is apparent that a system for stripping gold using an iodide-iodine water solution and then regenerating the solution is economic and commercially feasible. It will be understood that a sodium iodide-iodine solution can be substituted for the preferred potassium iodide-iodine solution. Using a buffer, hydroxyl ions are provided for the gold iodide reduction reaction which consume hydroxyl groups and hydrogen ions are provided for the iodine regeneration reaction. This "closed loop" gold reclamation process can be used to recover gold coated on a variety of materials, including metal, (both ferrous and nonferrous), plastic and ceramic materials. The sequence of processing steps has been described as a "closed loop" because during the cycle gold is initially dissolved by the stripping solution; gold then is precipitated from the stripping solution; and finally the stripping solution is restored to approximately its original concentration, thereby completing the cycle. Changes in color during the sequence of steps, from a brown color for the stripping solution, to a clear color for the solution following precipitation of the gold, to a brown color upon restoration of the stripping solution, provide visual indication of the sequence. Elemental iodine can be quantitatively recovered from the stripping solution should a need arise for such recovery.

From the foregoing, it will be seen that this invention is well adapted to obtain all of the ends and objects hereinabove set forth, together with other advantages which are obvious and which are inherent to the system. The present invention has significant ecological importance in addition to its apparent commercial importance. As indicated, the process overcomes many of the waste disposal and pollution abatement control problems of existing gold reclamation processes. A suitable vapor trap can be used to collect small amounts of iodine vapor which may escape from the solution during the process. The only other gases which are emitted by the process are non-polluting gases normally present in the air. The use of a buffer in the process minimizes salt buildup during the sequence of processing steps making it possible to repeat a larger number of closed loop cycles of usage.

While the invention has special usefulness in connection with the scrap metal reclamation industry, the process can also be used for the extraction of gold from gold bearing ores. In processing gold bearing ore the ore is commonly ground, e.g., to approximately 200 mesh, and then treated.

Obviously, many other modifications and variations of the invention as hereinbefore set forth may be made without departing from the spirit and scope thereof.

What is claimed is:

1. A process for extracting gold from gold bearing material which comprises:

treating the gold bearing material in an aqueous solution consisting essentially of iodine and a water soluble iodide salt to dissolve gold from said gold bearing material;

mixing a reducing agent with said aqueous solution to reduce dissolved gold iodide salts to gold metal and precipitate said gold metal in substantially pure form from said aqueous solution;

removing precipitated gold metal from said aqueous solution; and adding an oxidizing agent to said aqueous solution to thereby restore said solution to substantially its original condition for dissolving gold from further gold bearing material.

2. The process of claim 1 in which the precipitated gold metal is removed by filtering.

3. The process of claim 1 in which the aqueous solution comprises on a weight basis one part of iodine and between 0.7 and 20 parts of potassium iodide.

4. The process of claim 1 in which the reducing agent is sulfur dioxide.

5. The process of claim 1 in which the reducing agent is an alkaline solution of hydroxylamine.

6. The process of claim 1 in which the reducing agent is an alkaline solution of hydrazine.

7. The process of claim 1 which further includes recovering substantially all of the iodide from the aqueous solution after repeated use of said solution to dissolve gold from gold bearing material by acidifying said solution and adding an oxidizing agent to precipitate said iodide as elemental iodine, which can then be used in preparing new aqueous solutions of iodine and water soluble iodide salt.

8. A process for extracting gold from gold bearing material which comprises:

treating the gold bearing material in an aqueous solution consisting essentially of 10 parts of water, 1 part of iodine and between 0.7 and 20 parts of potassium iodide, on a weight basis, to dissolve gold from said gold bearing material;

mixing hydrazine and sodium hydroxide to said aqueous solution to reduce dissolved gold iodide salts to gold metal and precipitate said gold metal in substantially pure form from said aqueous solution, removing precipitated gold metal from said aqueous solution; and adding hydrogen peroxide to said aqueous solution to thereby restore said solution to substantially its original condition for reuse in dissolving gold from further gold bearing material.

9. A process for extracting gold from gold bearing material which comprises:

treating the gold bearing material in an aqueous solution consisting essentially of iodine and a water soluble iodide salt to dissolve gold from said gold bearing material;

mixing a reducing agent with said aqueous solution in the presence of buffer to reduce dissolved gold iodide salts to gold metal and precipitate said gold metal in substantially pure form from said aqueous solution, said buffer being capable of supplying hydroxyl ions during the precipitation of the gold metal;

removing precipitated gold metal from said aqueous solution; and adding an oxidizing agent to said aqueous solution in the presence of buffer to thereby restore said solution to substantially its original condition for dissolving gold from further gold bearing material, said buffer being capable of supplying hydrogen ions during the restoration of said solution.

10. The process of claim 9 which includes the step of removing the precipitated gold metal by filtering.

11. The process of claim 9 in which the aqueous solution comprises on a weight basis 1 part of iodine and between 0.7 and 20 parts of potassium iodide.

12. The process of claim 9 in which the reducing agent is hydroxyl amine, the buffer is ammonium acetate and the oxidizing agent is hydrogen peroxide.

13. The process of claim 9 in which the buffer is dibasic ammonium phosphate.

14. The process of claim 9 which further includes the step of agitating the aqueous solution in order to increase the rate the gold is dissolved.

15. The process of claim 9 in which an electromotive force is employed to increase the rate at which the gold is dissolved, said electromotive force being applied such that the gold bearing material is used as an anode.

16. A process for extracting gold from gold bearing material which comprises:

treating the gold bearing material in an aqueous solution consisting essentially of 10 parts of water, 1 part of iodine and between 0.7 and 20 parts of potassium iodide, on a weight basis, from said gold bearing material;

mixing hydrazine and sodium hydroxide to said aqueous solution in the presence of ammonium acetate to reduce dissolved gold iodide salts to gold metal and precipitate said gold metal in substantially pure form from said aqueous solution;

removing precipitated gold metal from said aqueous solution; and adding hydrogen peroxide to said aqueous solution in the presence of ammonium acetate to thereby restore said solution to substantially its original condition for reuse in dissolving gold from further gold bearing material.

* * * * *